United States Patent [19]

Tsuchiya et al.

[11] Patent Number: 4,754,863

[45] Date of Patent: Jul. 5, 1988

[54] WORKPIECE CONVEYOR

[75] Inventors: Hiroshi Tsuchiya; Kimikazu Ikemoto; Masami Sano, all of Toyota, Japan

[73] Assignees: Toyota Jidosha Kabushiki Kaisha; Taiho Seiki Kabushiki Kaisha, both of Toyota, Japan

[21] Appl. No.: 895,231

[22] Filed: Aug. 11, 1986

[51] Int. Cl.[4] ..... B65G 25/00

[52] U.S. Cl. ..... 198/339.1; 198/403; 198/468.2; 198/468.6; 198/775; 72/422

[58] Field of Search ..... 198/339.1, 403, 404, 198/468.2, 468.6, 774, 614, 775; 414/222, 223, 225, 226, 750, 751, 753, 771, 779, 783; 72/422

[56] References Cited

U.S. PATENT DOCUMENTS

| | | | |
|---|---|---|---|
| 3,391,802 | 7/1968 | Austin | 414/783 |
| 3,473,643 | 10/1969 | Janiske | 198/775 |
| 4,249,440 | 2/1981 | Feuillade | 198/403 |
| 4,279,561 | 7/1981 | Schneider et al. | 414/753 |
| 4,382,500 | 5/1983 | Oyama et al. | 198/468.2 |
| 4,523,670 | 6/1985 | Yanagisawa et al. | 198/403 |

FOREIGN PATENT DOCUMENTS

| | | | |
|---|---|---|---|
| 58-14763 | 1/1983 | Japan . | |
| 41630 | 3/1983 | Japan | 72/422 |
| 58-134233 | 8/1983 | Japan . | |

*Primary Examiner*—Joseph E. Valenza

*Attorney, Agent, or Firm*—Oblon, Fisher, Spivak, McClelland & Maier

[57] ABSTRACT

A workpiece conveyor for conveying a workpiece between presses is disclosed. The workpiece conveyor comprises first, second and third stations disposed between the presses, a reversing mechanism disposed at the first station and equipped with a pair of right and left reversing jaws that are driven separately for elevation and rotation, a first workpiece receiver disposed at the second station and capable of moving up and down, an unloader mechanism and a second workpiece receiver disposed on an unloader which is disposed at one of the end portions of a carriage capable of moving between the first to third stations, and a third workpiece receiver disposed at the other end of the carriage which is spaced apart from the second workpiece receiver by a distance equal to the distance between the stations.

5 Claims, 4 Drawing Sheets

WORKPIECE CONVEYOR

BACKGROUND OF THE INVENTION

1. Field of the Invention

This invention relates to a workpiece conveyor for conveying a workpiece between presses, and more particularly to a workpiece conveyor which is equipped with a 180° reversing mechanism of a workpiece and can feed the workpieces at a constant pitch.

2. Description of the Prior Art

One example of conventional workpiece conveyors is disclosed in Japanese Utility Model Laid-Open No. 14763/1983 and one example of an apparatus for reversing a workpiece by 180° is disclosed in "Work Transferring Apparatus" of Japanese Utility Model Laid-Open No. 134233/1983.

The workpiece conveyor disclosed in the first reference, i.e. Japanese Utility Model Laid-Open No. 14763/1983 has a construction wherein a carriage equipped with a workpiece receiver is slidably mounted on a carriage guide and reciprocatingly moved by means of a crank and a link mechanism. This conveyor provides the advantages that a stroke which is four times the crank radius can be obtained and the apparatus can be made compact as a whole. On the other hand, the apparatus disclosed in the second reference, i.e. Japanese Utility Model Laid-Open No. 134233/1983, has a construction wherein a slide guide is disposed between a pair of upper and lower sprockets and a workpiece clamping device is bridged between a chain wound on the sprockets and a slider fitted to the slide guide so that the slider is raised in such a manner as to follow up the rotation of the chain and the workpiece clamping device is reversed by 180° near the raised end of the slider. This apparatus has the advantage that it can be used for both reversion and non-reversion.

It has been customary in the art to incorporate a so-called "workpiece conveyor" and a reversing mechanism between two presses. If these two apparatuses are incorporated, it becomes necessary to dispose the workpiece conveyors disclosed in Japanese Utility Model Laid-Open No. 14763/1983 at a first station on a press side of a preceding step and at a third station on a press side of a subsequent step and to dispose the workpiece transferring apparatus of Japanese Utility Model Laid Open No. 134233/1983 at an intermediate second station. In this case, an arm type unloader is disposed on the press side of the preceding step and an arm type loader, on the press side of the subsequent step.

In the workpiece conveyor of the kind described above between a series of presses, however, the workpiece transferring apparatus greatly projects upward and the arms of the loader and unloader interfere with the workpiece transferring apparatus, resulting in the problem that the dimension of the workpiece must be limited or the pitch between the presses must be increased. In such a case, the application to existing presses having a small pitch is impossible and the advantage of the workpiece conveyor cannot be used fully.

On the other hand, the workpiece transferring apparatus described above is of such a type wherein the workpiece is drastically reversed near the raised end of the slider. Accordingly, if the workpiece is great in size and has low rigidity, strain is likely to occur in the workpiece due to wind pressure, impact at the start and subsequent steps, and so forth. Since the transverse width of the workpiece transferring apparatus is fixed in match with a maximum dimension workpiece, the reversing clamp arm must be elongated to handle a small work, whereby a load increase occurs and durability is decreased, eventually.

Besides the workpiece transferring apparatus described above, the reversing mechanisms include a windmill type, a rack-pinion type, and so forth, but each of them are complicated in construction and cannot easily cope with various shapes and sizes of workpieces.

SUMMARY OF THE INVENTION

In order to eliminate the problems of the prior art described above, the present invention provides a workpiece conveyor having a construction in which a reversing mechanism having a pair of right and left reversing jaws, which are separately driven for elevation and rotation, is disposed at a first station, a first workpiece receiver capable of elevation is disposed at a second station, an unloader mechanism and a second workpiece receiver are mounted on a lifter disposed at one of the end portions of a carriage, which is disposed movably between the first station and a third station, and a third workpiece receiver is disposed at the other end portion of the carriage which is spaced apart from the second workpiece receiver by the same distance as the distance from the second workpiece receiver to the station.

In the workpiece conveyor having the construction described above, the unloader mechanism mounted to the carriage first removes the workpiece from a press and transfers it to the reversing jaws inside the reversing mechanism by the advance of the carriage. The reversing jaws gradually rotate in one cycle of ascension and descension and reverse positioning of the workpiece and transfers the workpiece to the second workpiece receiver on the carriage that has resumed to its original position. Thereafter, as the carriage advances, the workpiece is transferred from the second workpiece receiver to the first workpiece receiver inside the second station. While the carriage is moving so as to repeat the operation described above, the workpiece is transferred from the first workpiece receiver to the third workpiece receiver on the carriage, and is then transferred to the loader that is disposed separately at the end of advance of the carriage.

Since the carriage is provided with the unloader function as described above, the reversing mechanism can be disposed at the first station, and reverse positioning and feeding of the workpiece at a constant speed can be accomplished in even a limited space between existing presses. Also, construction of the system can be simplified because one set of the unloaders of an arm type can be eliminated. Furthermore, since the reversing jaws are driven for independent elevation and rotation, reverse positioning of the workpiece in the course of a relatively long period can be made and hence, the occurrence of strain can be prevented in advance.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Hereinafter, one preferred embodiment of the present invention will be described with reference to the accompanying drawings.

Figure 1:
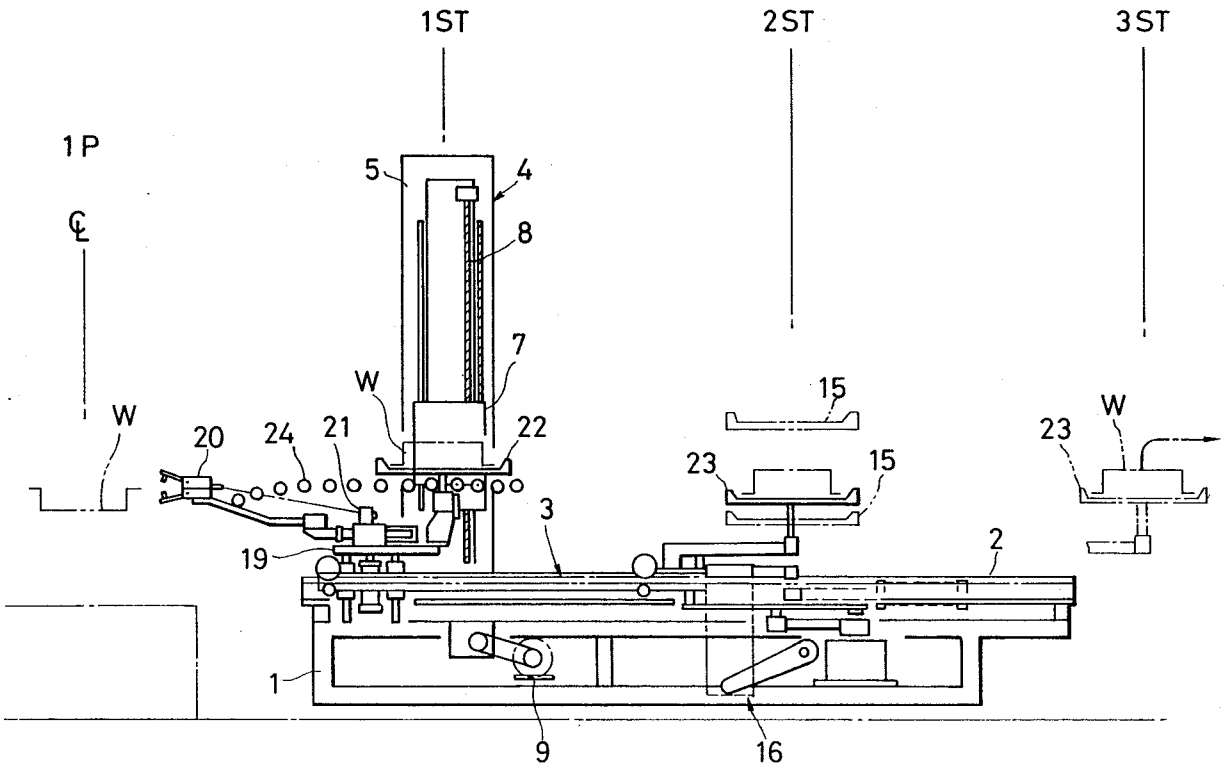
FIG. 1 is a front view showing the overall construction of a workpiece conveyor in accordance with the present invention.

FIG. 1 shows the overall construction of a workpiece conveyor in accordance with the present invention. The workpiece conveyor is disposed between a press 1P of a preceding step and a press of a next step (not shown), and is equipped with three stations as the relay stations of workpiece transfer operation of an equidistant pitch, that is, a first station 1ST, a second station 2ST and a third station 3ST. An elongated bed 1 is disposed in such a manner as to extend from the first station 1ST to the third station 3ST, and a carriage 3 is disposed on the bed 1 in such a manner as to be capable of moving along guide rails 2.

Figure 2:
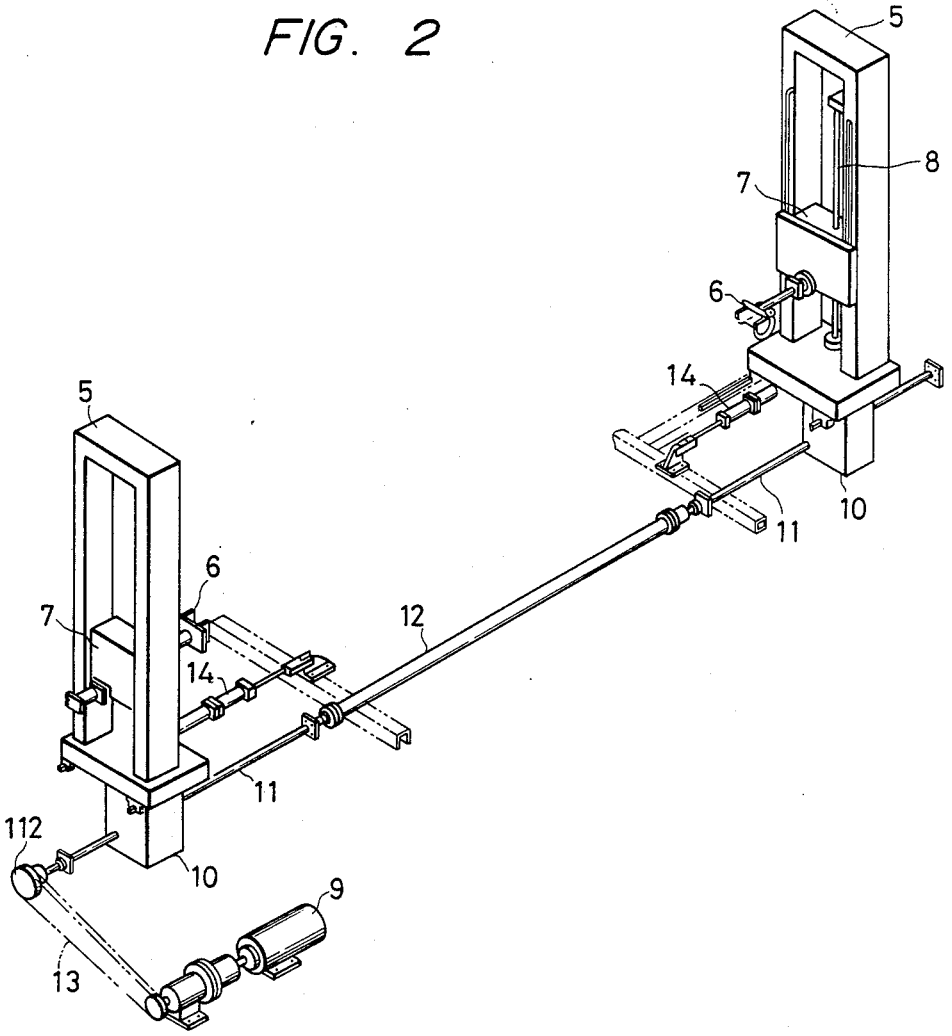
FIG. 2 is a perspective view showing a reversing mechanism.

A reversing mechanism 4 is disposed at the first station 1ST. As shown in FIG. 2, the reversing mechanism is formed by elevating a rotor unit 7 equipped with reversing jaws 6 to each of a pair of reversing mechanism frames 5 that are erected on the bed 1 in such a manner as to oppose each other. The rotor unit 7 can move up and down due to the rotation of a motor 9 in normal and reverse directions which motor meshes with a ball screw 8 extending vertically inside each reversing mechanism frame 5.

More specifically, the reversing jaw 6 can clamp and unclamp the workpiece W due to the operation of an clamping air cylinder and can be rotated arbitrarily by a motor for rotation incorporated in the rotor unit 7. On the other hand, one of the ends of the ball screw 8 is connected to a gear box 10 which is disposed at a lower part of the reversing mechanism frame 5. The gear box 10 has a built-in power conversion gear such as a worm gear, and two gear boxes 10 are connected to each other by spline shafts 11, 11 and a connecting shaft 12. A pulley 112 is fixed to one of the spline shafts 11, and a timing belt 13 is wound between this pulley 112 and the output shaft of the motor 9. In other words, the rotational driving force of the motor 9 is transmitted to the spline shaft 11 through the timing belt 13 and further through the gear box 10 upon synchronous rotation of the ball screw 8. When the ball screw 8 rotates, the rotor unit 7 and hence, the reversing jaws 6, move upward. If the motor for rotation is driven in the interim, the reversing jaws 6 can rotate arbitrarily through the elevational process described above.

Incidentally, the right and left reversing mechanism frames 5 can move in mutually separating and approaching directions by a cylinder 14. Therefore, the workpiece conveyor of the present invention can handle various workpieces by changing suitably their mutual distance without the necessity of changing the length of the reversing jaws 6. On the other hand, a first workpiece receiver 15 is mounted to the second station 2ST. This first workpiece receiver 15 is placed on a lifter 16 which is in turn disposed on the bed 1.

Figure 3:
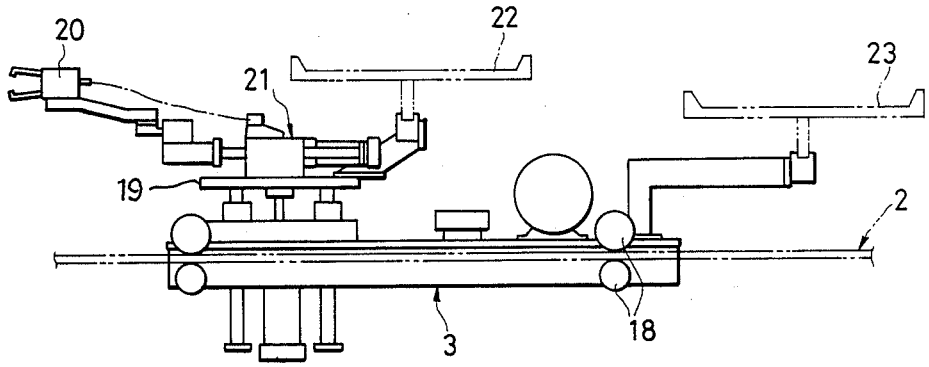
FIG. 3 is a front view showing components mounted to a carriage.

The carriage 3 moves back and forth on the guide rails 2 through rollers 18 by driving means (not shown) and preferably, by a link-lever mechanism disclosed in the afore-mentioned reference, Japanese Utility Model Laid-Open No. 14763/1983. An unloader lifter 119 is mounted to one of the end portions of the carriage 3 as shown in FIG. 3. A clamp unit 21 equipped with an unloader jaw 20 and a second workpiece receiver 22 is also mounted on the unloader lifter 19. The unloader jaw 20 can clamp and unclamp the finished workpiece W inside the press mold, and can move back and forth incrementally by an air cylinder incorporated in the clamp unit 21.

A third workpiece receiver 23 is fitted to the other end portion of the carriage 3. The third workpiece receiver 23 and the second workpiece receiver 22 on the unloader lifter 19 described above are spaced apart from each other by exactly the same distance as the pitch between the first station 1ST and the second station 2ST. Presuming that the carriage 3 is at the backward end (i.e., original position) as shown in FIG. 1, the second workpiece receiver 22 and the third workpiece receiver 23 are located at the first station 1ST and to the second station 2ST, respectively.

Figure 4:
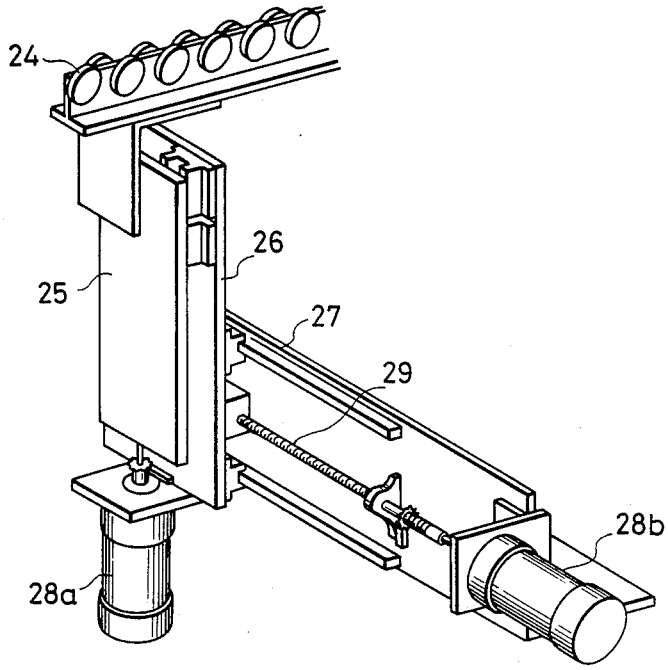
FIG. 4 is a perspective view showing the assembly structure of a workpiece receiving roller.

Two lines of right and left workpiece receiving rollers 24 are disposed at the first station 1ST. These rollers 24 support the lower surface of the workpiece W and guide the workpiece when the unloader jaw 20 charges the workpiece W, that has been clamped by the jaw 20, into the first station 1ST. The rollers have the assembled structure such as shown in FIG. 4, for example. Namely, the workpiece receiving rollers 24 are supported by a base 27 through a longitudinal slider 25 and a transverse slider 26. The longitudinal slider 25 is connected to a regulating motor 28*a*, which is fixed to the lower end of the transverse slider 26, and to a regulating motor 28*b*, which is fixed to one of the end portions of the support base 27 via a screw feed mechanism 29. The longitudinal slider 25 can be moved longitudinally and transversely by these regulating motors 28*a*, 28*b*, respectively. Accordingly, the gap and height of the right and left two lines of workpiece receiving rollers 24 can be regulated arbitrarily, and the conveyor of the present invention can be applied to a variety of workpieces.

Next, the action of the workpiece conveyor which has the construction described above will be explained.

First of all, the carriage 3 is located at the backward end portion as shown in FIG. 1 and is positioned such that it can remove the workpiece W, which has been press-molded, from the press mold. The unloader jaw 20 is first moved forth by the operation of the air cylinder inside the clamp unit 21 and then clamps the workpiece W. At the same time, the unloader lifter 19 moves upward. When the carriage 3 moves forward under this state, the workpiece W is removed from the press 1P while its lower surface is being supported by the workpiece receiving rollers 24, and is then charged to the first station 1ST.

The workpiece W thus charged to the first station 1ST is clamped by the reversing jaw 6 that has been in a waiting or stand-by state and at the same time, the unloader jaw 20 moves back and the unclamp lifter moves down, so that the carriage 3 returns to its original position (i.e. backward end). Then, the ball screw 8 is rotated by the operation of the motor 9 and the rotor unit 7 starts rising in response to operation of the former. The motor for rotation of the rotor unit 7 starts operating at an intermediate timing of this rise and the reversing jaw 6, and hence the workpiece W starts rotating and is rotated by 90° at the end of rising of the rotor unit 7.

Thereafter, the motor 9 rotates reversely and the rotor unit starts moving down. The reversing jaw 6 keeps rotation during this descension and finally, the workpiece W finishes rotation through 180°. At this time, the motor 9 and the motor for rotation stop. In the interim, the unloader jaw 20 clamps the next workpiece on the carriage 3 that has returned to its original position, and the unloader lifter 19 has finished rising by the time the workpiece W finishes its rotation. Under this condition, the reversing jaw 6 unclamps the workpiece W at the first station 1ST and the workpiece W is transferred to the second workpiece receiver 22 on the unloader lifter 19.

The motor 9 and the motor for generating rotation start rotating once again simultaneously upon completion of unclamping of the reversing jaw 6, and after rotation in the reverse direction and upon descending, the unloader jaw 6 returns to its original position and at the same time, the carriage 3 moves forth. The second workpiece receiver 22 is positioned at the second station 2ST at the end of advance of the carriage 3, whereby the lifter 16 rises up while the unloader 19 moves down, and the workpiece W is transferred to the first workpiece receiver 15.

Next, the carriage 3 moves back and the lifter 16, and hence the first workpiece receiver 15, move down at the backward end of the carriage 3, so that the workpiece W is transferred to the third workpiece receiver 23 on the carriage 3. Thereafter, the carriage 3 repeats the operations described above and then moves forward. The third workpiece receiver 23 is positioned at the third station 3ST at the end of the advance of the carriage 3, and the workpiece W is clamped by the loader (not shown) and is charged to the press for the next step.

Figure 5:
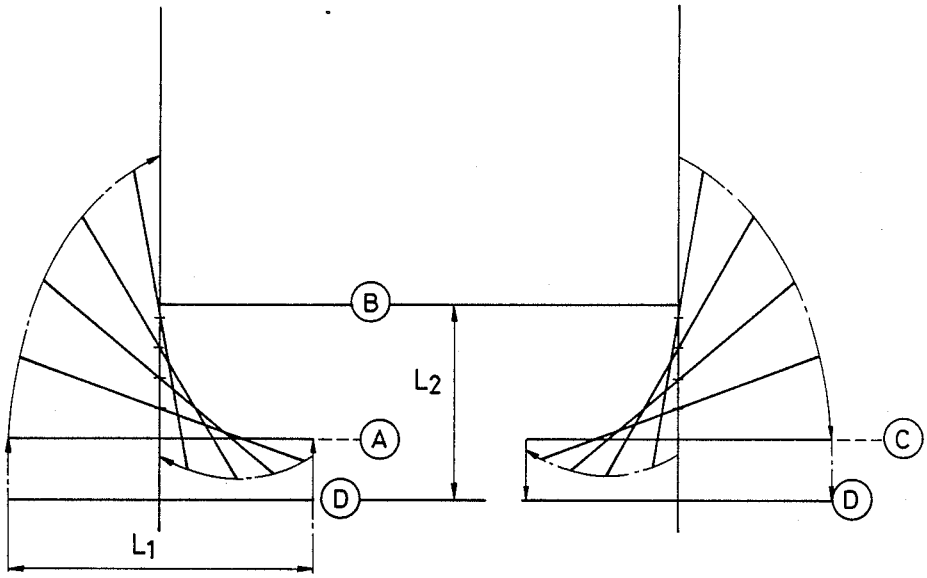
FIGS. 5 and 6 are explanatory views showing the operation of state of the reversing mechanism.
Figure 6:
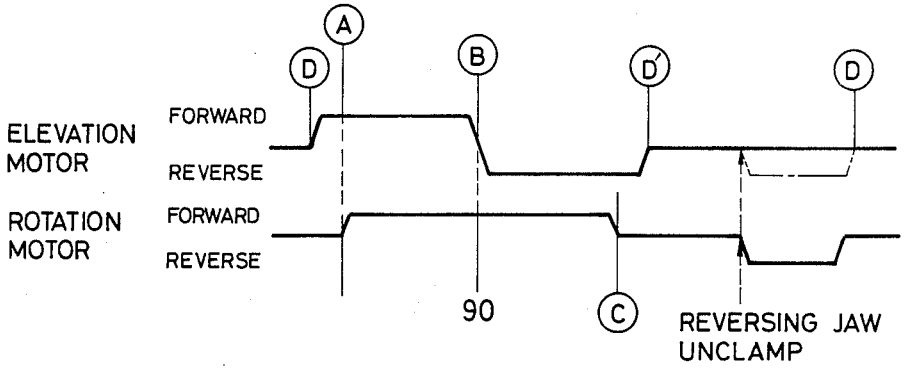

FIGS. 5 and 6 show a series of operations of the reversing mechanism 4 described above. When the reversing mechanism 4 receives a starting instruction, the motor 9 for elevation is first actuated, generates a rotation instruction at a point (A) midway in being raised and then keeps rising. Upon receiving the rotation instruction, the motor for rotation starts rotating and the motor 9 for elevation stops at the end of rise (B). At this time, the motor for rotation has rotated 90°. Thereafter, the motor 9 for causing elevation immediately rotates in the reverse direction and the reversing mechanism 4 starts moving down. The motor for rotation continues its rotation as such and has finished its rotation by 180° at a point (C). It further moves down until a point (D') is reached. After the unclamping operation by the reversing jaw 6 is confirmed, the motor 9 for elevation and the motor for rotation start rotating once again and the unloader jaw 6 returns to its original position. In FIG. 5, $L_1$ represents the width of the workpiece and $L_2$ represents a rising stroke.

In the manner described above, reversion of the workpiece W and its feed at a constant pitch become possible. Moreover, since the carriage 3 is provided with the unloader function and the reversing mechanism is disposed at the first station 1ST, the workpiece conveyor of this invention can be applied to existing presses having a small gap between them.

Though the foregoing description deals with the case where the workpiece W is subjected to replacement and transfer, the workpiece W can be transferred without reverse operation by not permitting the motor for rotation inside the rotor unit in the reversing mechanism 4 to rotate.

The means for regulating the mutual distance between the frames 5 of the reversing mechanism is not particularly limited to the cylinder 14 used in the embodiment described above, and other means such as screw feed means can of course be used. The longitudinal and transverse regulation mechanisms of the workpiece receiving rollers 24 are not particularly limited to the combination of the motors **28*a*, 28*b* with the screw feed mechanism 29, and other means such as cylinders can of course be used. Furthermore, the driving mechanism of the ball screw 8** is not particularly limited to one that is used in the embodiment, and various other driving mechanisms can of course be used.

As described in detail above, in the workpiece conveyor in accordance with the oresent invention, the carriage moving between the stations is provided with an unloader function and the reversing mechanism is disposed at the first station on the take-out side of the workpiece. Therefore, the present invention can efficiently feed the workpiece at a constant pitch by either reversing or not reversing the workpiece.

In addition, since one set of the arm type unloader becomes unnecessary, construction of the system can be simplified.

Furthermore, the reversing mechanism includes means for gradually rotating the workpiece through its elevation process, so that the occurrence of strain in the workpiece can be prevented in advance and the kinds of workpieces that can be handled can be expanded. Since the lateral width of the reversing mechanism can be adjusted, its constituent elements such as the reversing jaws may be small in size and light in weight, replacement of jigs can be accomplished easily and durability can be improved due to the reduction of the load.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A workpiece conveyor, comprising:

first, second and third stations disposed in such a manner as to extend between a press of a preceding step and a press of a next step;

a carriage adapted for moving between said first, second and third stations;

a reversing mechanism which includes a pair of right and left reversing jaws and means for driving said jaws independently and separately for elevation and rotation, wherein said reversing mechanism is disposed at said first station;

first horizontally stationary workpiece receiver means disposed at said second station and movable up and down;

an unloader mechanism mounted on said carriage;

second workpiece receiver means disposed on said unloader and which is disposed at a first end portion of said carriage; and third workpiece receiver means disposed at a second end of said carriage and which is spaced apart from said second workpiece receiver means by a distance equal to a distance between each of said stations.

2. The workpiece conveyor as defined in claim 1, further comprising a plurality of rotor units and a plurality of reversing mechanism frames for supporting said reversing jaws through said rotor units.

3. The workpiece conveyor as defined in claim 1, further comprising first and second lines of right and left workpiece receiving rollers disposed at said first station.

4. A workpiece conveyor as defined in claim 1, wherein said reversing mechanism includes means for rotating said workpiece through 180°.

5. A workpiece conveyor as defined in claim 1, wherein said reversing mechanism includes means for rotating said workpiece 90° during elevation and through an additional 90° upon completion of downward movement.

* * * * *